US005971449A

United States Patent [19]

Rogers, Jr. et al.

[11] Patent Number: 5,971,449

[45] Date of Patent: Oct. 26, 1999

[54] VEHICLE DOOR LATCH

[75] Inventors: Lloyd Walker Rogers, Jr., Shelby Township, Macomb County; Reginald Leo McDonald, Msacomb Township, Macomb County; John R. Rice, Clinton Township, Macomb County; David A. Sedlak, Clarkston, all of Mich.

[73] Assignee: General Motor Corporation, Detroit, Mich.

[21] Appl. No.: 09/106,545

[22] Filed: Jun. 29, 1998

[51] Int. Cl.[6] ..... E05C 3/04

[52] U.S. Cl. ..... 292/216; 292/336.3

[58] Field of Search ..... 292/216, DIG. 23, 292/DIG. 27, DIG. 65, 336.3

[56] References Cited

U.S. PATENT DOCUMENTS

| | | | |
|---|---|---|---|
| 3,840,258 | 10/1974 | Brackmann | 292/216 |
| 4,586,737 | 5/1986 | Arlauskas | 292/216 |
| 5,100,185 | 3/1992 | Menke et al. | 292/216 |
| 5,277,461 | 1/1994 | Dzurko et al. | 292/216 |
| 5,803,515 | 9/1998 | Arabia, Jr. et al. | 292/216 |

*Primary Examiner*—Steven Meyers
*Assistant Examiner*—John B. Walsh
*Attorney, Agent, or Firm*—Charles E. Leahy; Kathryn A. Marra

[57] ABSTRACT

A vehicle door latch has a locking mechanism and an unlatching mechanism that cooperate with each other and an inside handle lever so the door latch can be unlocked and unlatched by an inside door handle or the like.

12 Claims, 7 Drawing Sheets

VEHICLE DOOR LATCH

TECHNICAL FIELD

This invention relates generally to a vehicle door latch and more particularly to a vehicle door latch that has a latching mechanism for operating the vehicle door latch and a locking mechanism for disabling the latching mechanism.

BACKGROUND OF THE INVENTION

An automotive closure, such as a door for an automobile passenger compartment, is hinged to swing between open and closed positions and conventionally includes a door latch that is housed between inner and outer panels of the door. The door latch functions in a well known manner to latch the door when it is closed and to lock the door in the closed position and to unlock and unlatch the door so that the door can be opened manually.

The door latch is operated remotely from the exterior of the automobile by two distinct operators—a key cylinder that controls the locking mechanism and an outside door handle or push button that controls the latching mechanism.

The door latch is also operated remotely from inside the passenger compartment by two distinct operators—a sill button that controls the locking mechanism and a handle that controls the latching mechanism. Vehicle door latches for upscale automobiles may also include power door locks in which the locking mechanism is motor driven and/or a keyless entry in which a key fob transmitter sends a signal to a receiver in the vehicle to operate the motor driven locking mechanism.

U.S. Pat. No. 5,277,461 granted to Thomas A. Dzurko et al on Jan. 11, 1997 for a vehicle door latch, which is hereby incorporated in this patent specification by reference, discloses a typical door latch of the above-noted type. The door latch disclosed in the Dzurko '461 patent includes an unlatching lever 60 that is pivotally mounted on a stud 28 that is secured to a metal back plate 16 and a metal face plate 14 at opposite ends. Unlatching lever 60 is operated to unlatch the vehicle door by an inside handle lever 56 that is connected by a suitable linkage for rotation by an inside door handle (not shown). Unlatching lever 60 is also operated by an outside handle lever 50 that is connected by suitable linkage for rotation by an outside door handle (not shown).

The Dzurko door latch also includes a locking lever 40 that is pivotally mounted on stud 28. Locking lever 40 is operated by an inside locking lever 80 that is pivotally mounted on the flange of the metal face plate 14 near the inside handle lever 56. The inside locking lever 80 is operated by an inside sill button or lock slide through a suitable linkage (not shown). Locking lever 40 is also operated by an outside locking lever 82 that is operated by a key lock cylinder through a suitable linkage (not shown). In some instances, for example in upscale automobiles, locking lever 40 is also power operated by a remotely controlled linear electric motor or the like in a well known manner (not shown).

The door latch disclosed in the Dzurko '461 patent is unlocked and unlatched in the following sequence. First, the locking lever 40 is moved to the unlocked position by the inside locking lever 80, the outside locking lever 82 or, in the instance of vehicle equipped with power door locks, a remotely controlled motor. This moves the intermittent lever 34 to the unlocked position. After the door latch is unlocked, the door latch is unlatched by moving the unlatching lever 60 via inside handle lever 56 or outside handle lever 50 to the unlatched position, pulling intermittent lever 44 and detent 32 down to unlatch the vehicle door. The vehicle door then may be pushed or pulled open manually.

Door latches of the type disclosed in the Dzurko '461 patent have been used successfully by General Motors Corporation for many years.

However, there are instances where it is desirable to be able to unlock as well as unlatch the door latch from inside the vehicle using the same operator, such as an inside door handle that is connected to the inside handle lever by a suitable linkage.

SUMMARY OF THE INVENTION

The object of this invention is to provide a vehicle door latch that has a locking mechanism and a latching mechanism and an inside handle lever that cooperate so that the door latch can be unlocked and unlatched using the same operator, such as an inside door handle that is connected to the inside handle lever by suitable linkage.

A feature of the vehicle door latch of the invention is that the vehicle door latch has an inside locking lever for unlocking the vehicle door latch and an inside handle lever for unlatching the vehicle door latch that also operates on the inside locking lever to unlock the vehicle door latch.

Another feature of the invention is that the vehicle door latch has an intermittent lever for unlatching the door latch and an inside handle lever that drives a transfer member that drives the intermittent lever in an unlatching operation and yields to the intermittent lever in an unlocking operation.

Another feature of the vehicle door latch of the invention is that the vehicle door latch has an inside locking lever for unlocking the vehicle door latch and an inside handle lever for unlatching the vehicle door latch that cams the inside locking lever to unlock the vehicle door latch if the vehicle door latch is locked and then unlatches the vehicle door latch in a second stroke.

Another feature of the vehicle door latch of the invention is that the vehicle door latch has an intermittent lever for unlatching the door latch and an inside handle lever that drives a transfer member that yields to the intermittent lever in an unlocking operation and then drives the intermittent lever in an unlatching operation in a second stroke.

Yet another feature of the vehicle door latch of the invention is that the vehicle door latch has a transfer member that pivots on an unlatching lever and either drives an intermittent lever in an unlatching operation or yields to the intermittent lever in an unlocking operation.

Still another feature of the vehicle door latch of the invention is that the vehicle door latch has a transfer member that pivots on an unlatching lever and a spring that holds the transfer member in position to drive an intermittent lever to unlatch the door latch.

Still yet another feature of the vehicle door latch of the invention is that the vehicle door latch has a transfer member that has a pivot pin that is journalled in a hole of an unlatching lever and extends into a slot in an outside handle lever for driving an intermittent lever by an outside door handle.

These and other objects, features and advantages of the invention will become apparent from the description below, which is given by way of example with reference to the accompanying drawings.

DESCRIPTION OF THE PREFERRED EMBODIMENT

The Prior Art Door Latch

Figure 1:
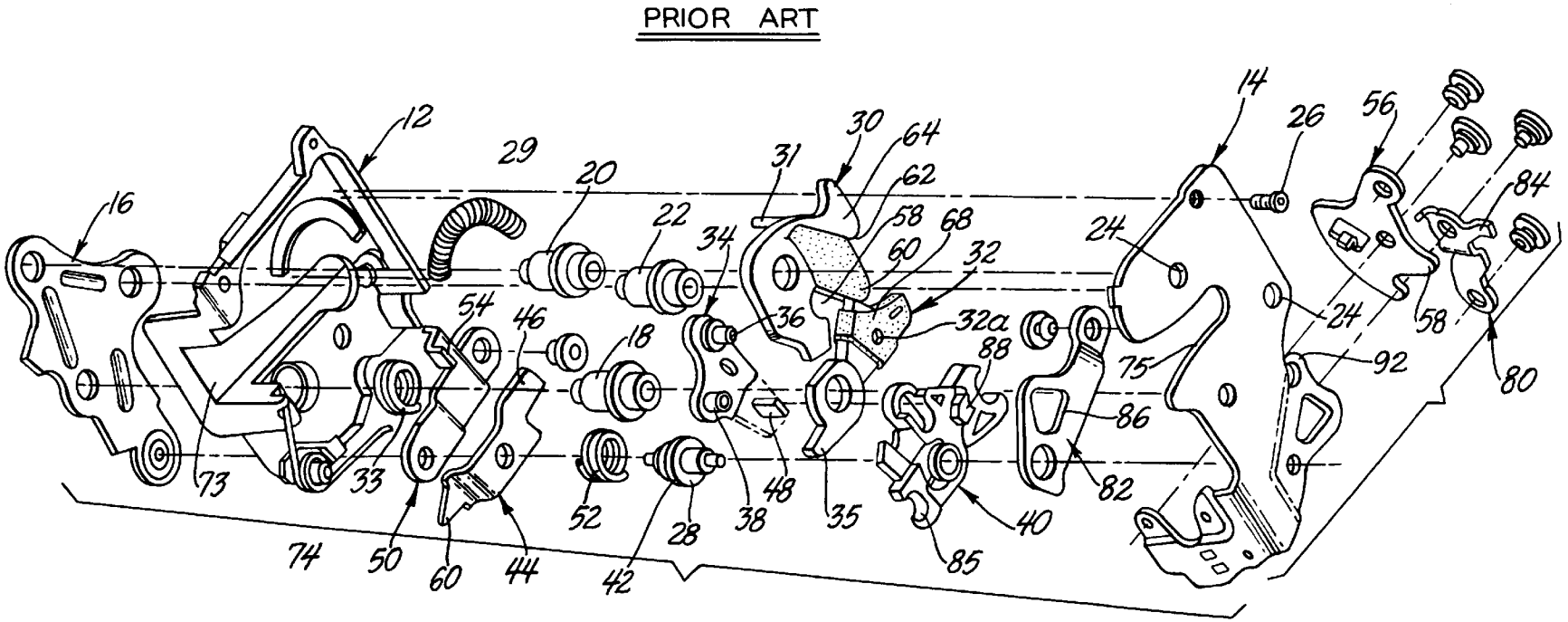
FIG. 1 is an exploded perspective front view of a prior art vehicle door latch.

Referring now to FIG. 1, the prior art vehicle door latch 10 has a multi-piece enclosure that comprises plastic housing 12, metal face plate 14 and metal back plate 16. The plastic housing 12 and the metal back plate 16 are held together by three flanged, internally threaded bushings 18, 20 and 22 that are inserted into three holes in the plastic housing 12, then through three aligned holes in the back plate 16 and then flanged over the back plate. The metal face plate 14 has three bolt holes 24 that are aligned with the bushings 18, 20 and 22 when the metal face plate is attached to the plastic housing 12 by a screw 26. The metal face plate 14 and the metal back plate 16 have lower portions below the plastic housing 12 that are held together by a flanged stud 28 that has projecting pins at each end that are inserted in holes in the plates and peened or headed over.

The Prior Art Latch Mechanism

The latch mechanism of the prior art vehicle door latch 10 comprises a fork bolt 30 and a cooperating detent 32 that are pivotally mounted on bushings 20 and 18, respectively, and located in a chamber of the plastic housing 12 behind the metal face plate 14. The fork bolt 30 is biased clockwise by a coil spring 29. Coil spring 29 is disposed in a curved slot in the plastic housing 12 behind the fork bolt 30 and it engages a depending pin 31 of the fork bolt 30 at one end. Detent 32 is biased counterclockwise into engagement with the fork bolt 30 by a coil spring 33 that surrounds the bushing 18 and that has one end engaging an ear 35 of the detent 32. Detent 32 engages and holds the fork bolt lever 30 in a primary latched position against the bias of spring 29 as shown in FIG. 1. Detent 32 also can engage fork bolt 30 at 62 and hold it in an intermediate secondary latched position. Detent 32 engages fork bolt 30 at foot 64 in its unlatched position.

The latching mechanism further comprises an intermittent lever 34 for operating the detent 32. The intermittent lever 34 is located in the chamber of the plastic housing 12 behind detent 32. It has two integral pivot pins 36 and 38. Pivot pin 36 is journalled in a hole 32*a* in detent 32 so that the detent 32 rotates clockwise from the position shown in FIG. 1 (and out of latched engagement with the fork bolt 30) to the unlatched position when the intermittent lever 34 is pulled down. The pivot pin 38 is disposed in a slot of a locking lever 40 that pivots the intermittent lever 34 counterclockwise about pivot pin 36 from the unlock position shown in FIG. 1 to a lock position (not shown). The locking lever 40 is journalled on the stud 28 between the flange 42 and the face plate 14. Briefly, the locking lever 40 is rotated clockwise to lock the door latch 10 or counterclockwise to unlock the door latch. Clockwise rotation pivots intermittent lever 34 counterclockwise about pivot pin 36 to a position where it is uncoupled from and out of the path of travel of unlatching lever 44 as described below. A more complete description of the locking lever 40 and lock mechanism is given after the latching mechanism is described.

The latch mechanism further comprises unlatching lever 44 that is journalled on a reduced diameter portion of the stud 28 spaced rearwardly of the flange 42. The unlatching lever 44 has an ear 46 at one end that is engageable with an integral, rearwardly projecting tab 48 of the intermittent lever 34 so that the intermittent lever 34 is pulled down when the transfer lever 44 is rotated clockwise as viewed in FIG. 1.

The latch mechanism further comprises an outside handle lever 50 and a coil return spring 52. Handle lever 50 is also journalled on the reduced diameter portion of the stud 28 behind the unlatching lever 44. It has a bent tab 54 that engages the ear 46 of the unlatching lever 44 so that the outside handle lever 50 rotates the unlatching lever 44 clockwise when it is rotated clockwise on stud 28. Outside handle lever 50 is connected by suitable linkage for rotation by an outside door handle (not shown).

The coil return spring 52 is disposed around the stud 28 and located between the flange 42 and the unlatching lever 44. One end of the coil spring 52 engages the bottom of unlatching lever 44 and the other end engages the bottom of the plastic housing 12 above the unlatching lever 44 so that unlatching lever 44 and outside handle lever 50 are biased counterclockwise to a rest position where tab 54 engages the bottom of the plastic housing 12.

The latch mechanism further comprises an inside handle lever 56 that is pivotally mounted on a flange 15 of the metal face plate 14. Inside handle lever 56 has a tab 58 that engages a second ear 60 of unlatching lever 44 so that inside handle lever 56 also rotates unlatching lever 44 clockwise when it is rotated counterclockwise. Inside handle lever 56 is connected by suitable linkage for rotation by an inside door handle or other operator (not shown).

Fork bolt 30 has a conventional slot or throat 58 for receiving and retaining a strike member that is attached to the vehicle door pillar to latch the vehicle door in the closed position (not shown). Fork bolt 30 also includes a primary latch shoulder 60, an intermediate secondary latch shoulder 62 and a radially projecting foot 64. Fork bolt 30 preferably has a plastic coating that covers a surface of the slot 58 that is engaged by the striker for energy absorption and quiet operation when the vehicle door is slammed shut.

Detent 32 has a sector shaped catch 68 that engages the radially projecting foot 64 when the fork bolt 30 is in the unlatched position (not shown). The sector shaped catch 68 positively engages the primary and secondary latch shoulders 60 and 62 to hold the fork bolt 30 in either the primary or the intermediate secondary latched positions shown in FIG. 1 and not shown, respectively. Detent 32 also preferably includes a plastic coating that has an integral bumper. The bumper engages the bushing 22 to stop counterclockwise pivoting of the detent lever 32 under the bias of spring 52. This bumper also absorbs energy and quiets operation when the door is slammed shut.

The latch mechanism described above operates as follows. When the door latch 10 is in an unlatched and unlocked condition, fork bolt 30 is poised to receive a conventional strike member (not shown) that projects into aligned fish mouth slots 73 and 75 of the plastic housing 12 and the metal face plate 14 when the door is shut. The entering strike member engages the plastic coating at the back of the throat 58 and rotates fork bolt 30 counterclockwise against the bias of spring 29 until fork bolt 30 is rotated to the primary latch position shown in FIG. 1 where fork bolt 30 captures the striker in the throat 58. Fork bolt 30 is held in the primary latch position by catch 68 of detent 32 engaging the primary latch shoulder 60 of fork bolt 30.

Catch 68 rides along the periphery of the fork bolt 30 under the bias of spring 52 as fork bolt 30 rotates counterclockwise from the unlatched position to the primary latch position shown in FIG. 1. During this travel, catch 68 rides under the foot 64 into engagement with the intermediate secondary latch shoulder 62 and then under the coated portion into engagement with the primary latch shoulder 60. It is to be noted that the engagement of catch 68 with the intermediate secondary latching shoulder 62 is sufficient to hold the vehicle door closed in the event that the vehicle door is not shut with sufficient force so that catch 68 engages primary latch shoulder 60.

The vehicle door latch 10 is now latched but not locked so that the vehicle door can be opened simply by operating either an inside or outside door handle or the like to rotate the unlatching lever 44 clockwise moving the ear 46 down as viewed in FIG. 1. Ear 46 engages projection 48 of intermittent lever 34 and pulls the intermittent lever 34 down from the primary latch position shown in FIG. 1. As the intermittent lever 34 is pulled down, it rotates detent 32 clockwise against the bias of spring 52 from the primary latch position shown in FIG. 1. Fork bolt 30 is then free to rotate counterclockwise under the bias of spring 29 from the primary latch position shown in FIG. 1 to an unlatched position as the striker is pulled out of the aligned fish mouth slots 73 and 75 when the vehicle door is opened.

The Prior Art Lock Mechanism

The lock mechanism of door latch 10 is actuated by rotating the locking lever 40 that is journalled on stud 28 between flange 42 and face plate 14 clockwise. Clockwise rotation of the locking lever 40 rotates intermittent lever 34 counterclockwise about the pivot pin 36 that is journalled in the detent 32 due to the engagement of the second pivot pin 38 of the intermittent lever 34 in the slot of the locking lever. Intermittent lever 34 is thus rotated counterclockwise from the unlocked position shown in FIG. 1 to a locked position where projection 48 is repositioned out from under ear 46 of unlocking lever 46. Consequently, when the door handles or the like are operated so as to rotate the unlatching lever 44 clockwise to the unlatching position, the ear 46 simply bypasses the projection 48 without transferring any motion to the intermittent lever 34. Consequently, intermittent lever 34 is not pulled down to rotate detent 32 to the unlatch position. In other words, the unlatching lever 44 simply free wheels so that operation of the door handles or their equivalent is not effective.

The lock mechanism further comprises an inside locking lever 80 and an outside lock lever 82. Inside locking lever 80 is pivotally mounted on flange 15 of the metal face plate 14 at a location spaced from the pivot for the inside handle lever 56. Inside locking lever 80 has an ear 84 that fits in a slot 90 at one end of locking lever 40. Outside locking lever 82 is pivotally mounted on stud 28 in front of locking lever 40. Locking lever 40 has a protuberance 88 that projects through a sector shaped hole 86 in outside locking lever 82 and then through a smaller sector shaped hole 90 in face plate 14.

Protuberance 88 and sector shaped hole 90 limit rotation of locking lever 40 from an unlocked position shown in FIG. 1 where protuberance 88 engages the upper edge of hole 90 to a locked position (not shown) where protuberance 88 engages the lower edge of hole 90.

Locking lever 40 is rotated clockwise from the unlocked position shown in FIG. 1 to the locked position by rotating inside locking lever 80 counterclockwise as viewed in FIG. 1. Inside locking lever 80 is actuated by a suitable linkage system (not shown) for rotation by an inside sill button or other operator (not shown).

Locking lever 40 can also be rotated clockwise from the unlocked position shown in FIG. 1 to the locked position by rotating outside locking lever 82 clockwise. Outside locking lever 82 is generally actuated by a key lock cylinder through a suitable linkage (not shown). Outside locking lever 82 is an optional member that may be omitted in rear door applications that do not have a lock cylinder. Locking lever 40 also has a slot 85 for operating the locking lever 40 by power, for instance by a linear electric or vacuum motor.

The Prior Art Unlocking and Unlatching Operation

When locked vehicle door latch 10 is locked and latched, door latch 10 is unlocked and then unlatched by two distinct operators. First, unlocking lever 40 is rotated counterclockwise to the position shown in FIG. 1 either by a key lock cylinder (not shown) acting via outside locking lever 82, an inside sill button or the like (not shown) acting via inside locking lever 80 or a motor (not shown). This rotation moves tab 48 of intermittent lever 34 beneath ear 46 of unlatching lever 60. Door latch 10 is then unlatched by rotating unlatching lever 44 clockwise by a second distinct operator such as an outside door handle (not shown) acting via outside handle lever 50 or an inside door handle (not shown) acting via inside handle lever 56. This rotation pulls intermittent lever 34 down and releases detent 32 from lock bolt 30. This unlocking and unlatching operation requires manipulation of two distinct operators. Moreover, the specific unlocking/unlatching sequence must be followed because premature operation of unlatching lever 44 blocks intermittent lever 34 in the locked position if unlatching lever 44 is actuated first.

The Vehicle Door Latch of the Invention

The vehicle door latch 100 of the invention is shown in FIGS. 2–7. Vehicle door latch 100 includes essentially all of the components described above in connection with door latch 10 except for replacement of unlatching lever 44 and outside handle lever 50 that are pivotally mounted on stud 28 and the replacement of inside handle lever 56 and inside locking lever 80 that are pivotally mounted on flange 15. The remaining components of door latch 10 and door latch 100 are substantially identical except for the elimination of interlock projection on locking lever 40 that is described in the Dzurko '461 patent discussed above. Corresponding components are identified with the same numerals in FIG. 1 and FIGS. 2–7.

Figure 2:
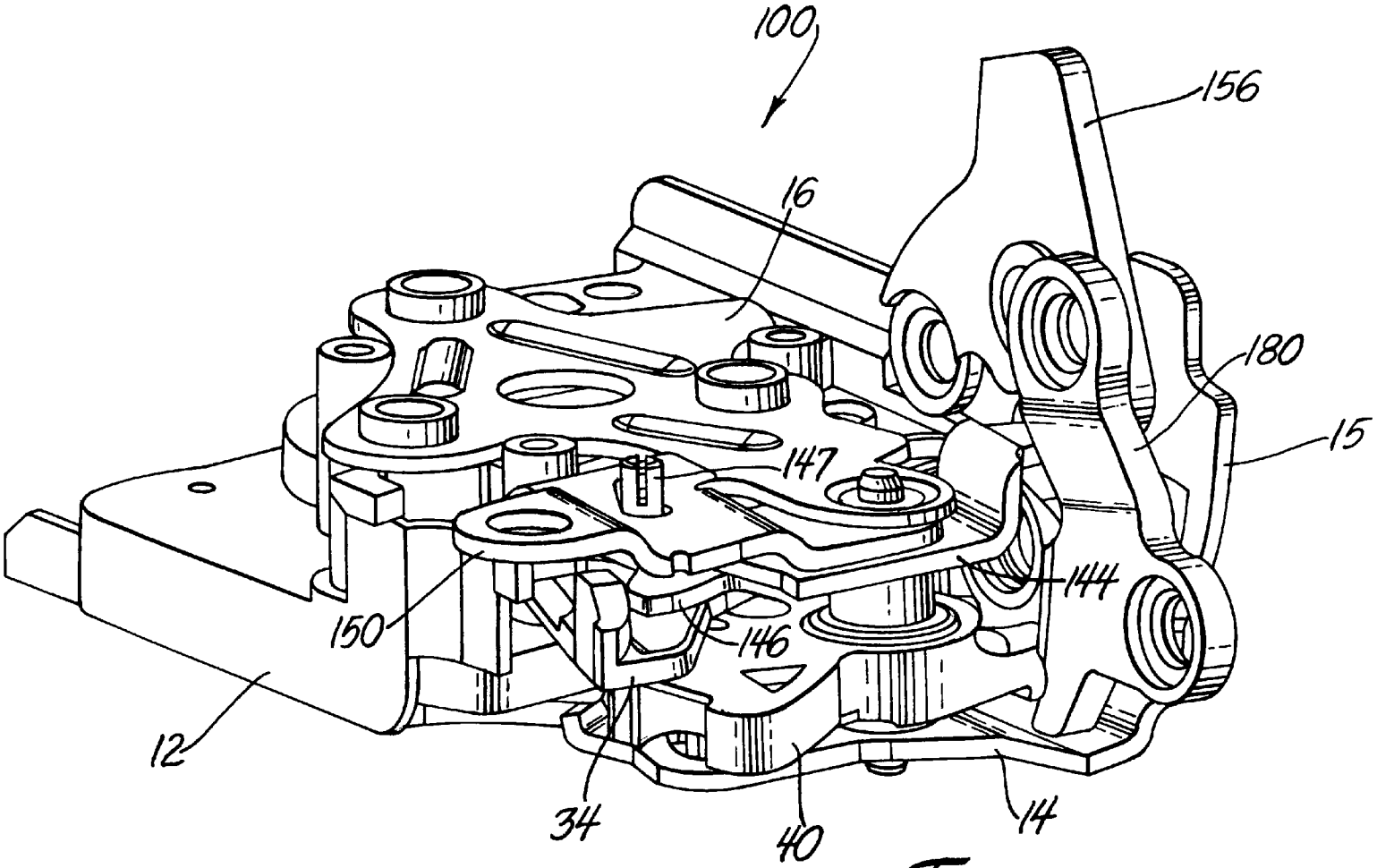
FIG. 2 is a perspective rear view of a vehicle door latch in accordance with the invention.
Figure 3:
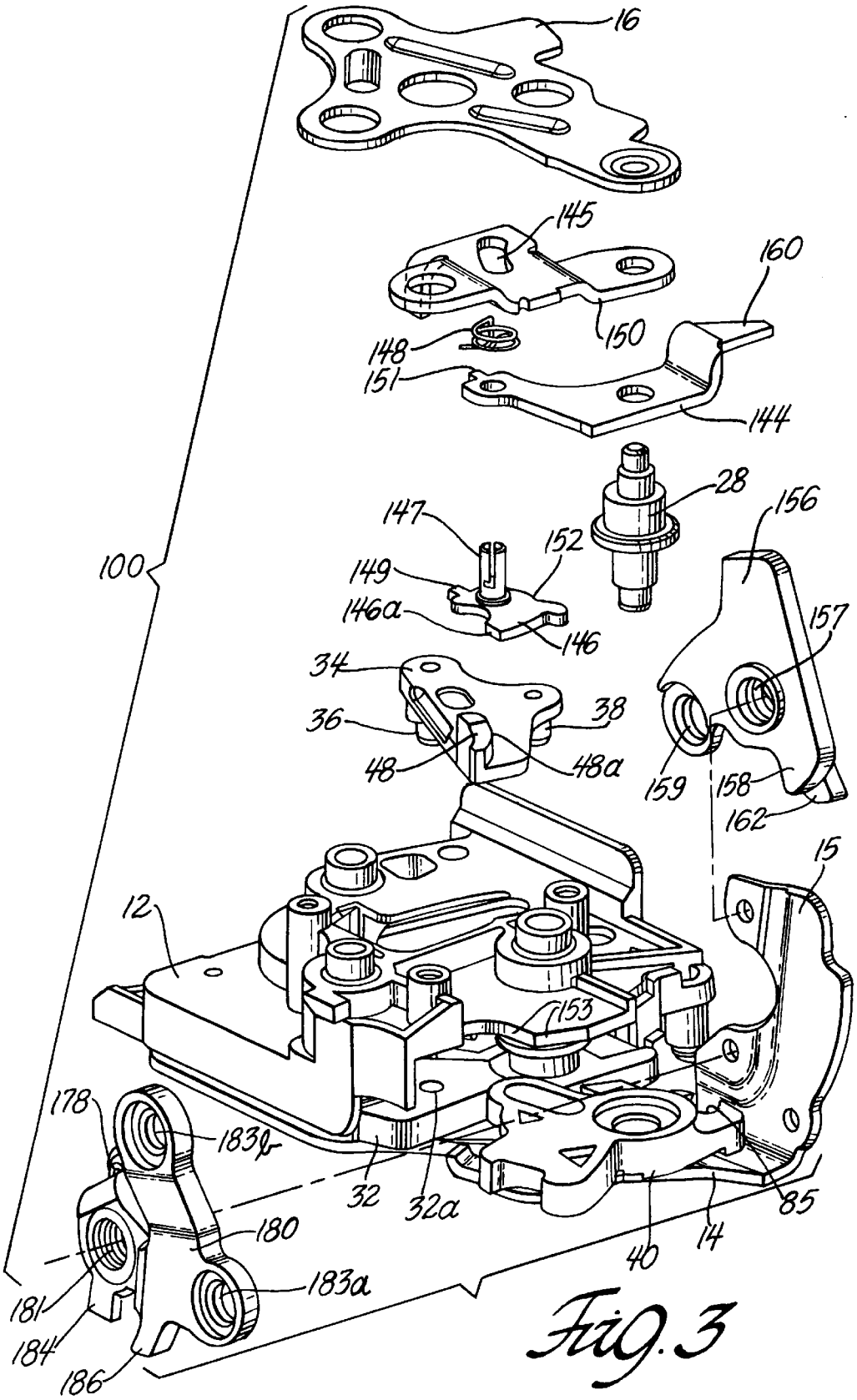
FIG. 3 is a partially exploded, perspective rear view of the vehicle door latch shown in FIG. 2.

Referring now to FIGS. 2 and 3, vehicle door latch 100 comprises an unlatching lever 144, a transfer member 146, a coil spring 148 and an outside handle lever 150 in place of the prior art unlatching lever 44 and outside handle lever 50 shown in FIG. 1.

Unlatching lever 144 and outside handle lever 150 are pivotally mounted on stud 28. Transfer member 146 pivots on unlatching lever 144 by means of an integral pin 147 that extends through a journal hole in an elevated end of the unlatching lever 144 and into a slot 145 of outside handle lever 150.

Unlatching lever 144 is generally horizontal in the latched position and transfer member 146 hangs vertically from the elevated end of unlatching lever 144. Coil spring 148 surrounds pin 147 and is located between unlatching lever 144 and outside handle lever 150. Coil spring 148 has one end anchored in a slot of pin 147 and the other end engaging a stop tab 151 of unlatching lever 144 so that spring 148 biases transfer member 146 counterclockwise away from stud 28 until stop tab 149 engages stop tab 151 of unlatching lever 144. Transfer member 146 includes a cam surface 152 that cooperates with surfaces 153 of housing 12 as explained below.

Vehicle door latch 100 further comprises an inside handle lever 156 and an inside locking lever 180 in place of the prior art inside handle lever 56 and inside locking lever 80.

Inside handle lever 156 is pivotally mounted on flange 15 by means of a journal hole 157 and includes an attachment hole 159 for connecting the inside handle lever 157 to an inside door handle or the like through suitable linkage (not shown). Inside handle lever 156 has a coplanar end tab 158 for engaging ear 160 of unlatching lever 144 and driving the unlatching lever 144 to the unlatching position. Inside handle lever 156 also has an integral cam arm 162 that is parallel to and offset laterally from end tab 158. Cam arm 162 engages follower pin 178 of inside locking lever 180 and drives inside locking lever 180 from a locked position to an unlocked position as explained below. Inside locking lever 180 is pivotally mounted on flange 15 by means of a journal hole 181 and includes two optional attachment holes 183*a* and 183*b* for connecting inside locking lever 180 to a sill button or to a motor through suitable linkage (not shown). Inside locking lever 180 further includes tab 184 that engages in socket 85 of locking lever 40 for moving locking lever 40 back and forth between the locked and unlocked positions. Inside locking lever 180 preferably further includes stop tab 186 that engages face plate 14 when inside locking lever 180 is in the locked position.

The Conventional Unlocking and Unlatching Operation

Door latch 100 can be unlocked and unlatched in a conventional manner using separate operators for the latching mechanism and the locking mechanism. In this instance, door latch 100 unlocks and unlatches essentially as described above in connection with door latch 10, the only difference being that the unlatching lever 144 pushes down on tab 48 of intermittent lever 34 through the transfer member 146 which is vertically positioned by spring 148. In this regard, transfer member 146 is preferably shaped so that tab 48 torques transfer member 146 counterclockwise against stop tab 151 when tab 48 is pushed down. However, door latch 100 can also be unlocked and unlatched by using a single operator and stroking the single operator twice as described below.

The Double Pump Unlatching and Unlocking Operation

Door latch 100 can be unlocked and unlatched by using a single operator, such as an inside door handle, or the like that is connected to inside handle lever 156 by suitable linkage, and stroking the operator twice, which may be characterized as a "double pump" operation. The double pump operation of door latch 100 is as follows.

Figure 4B:
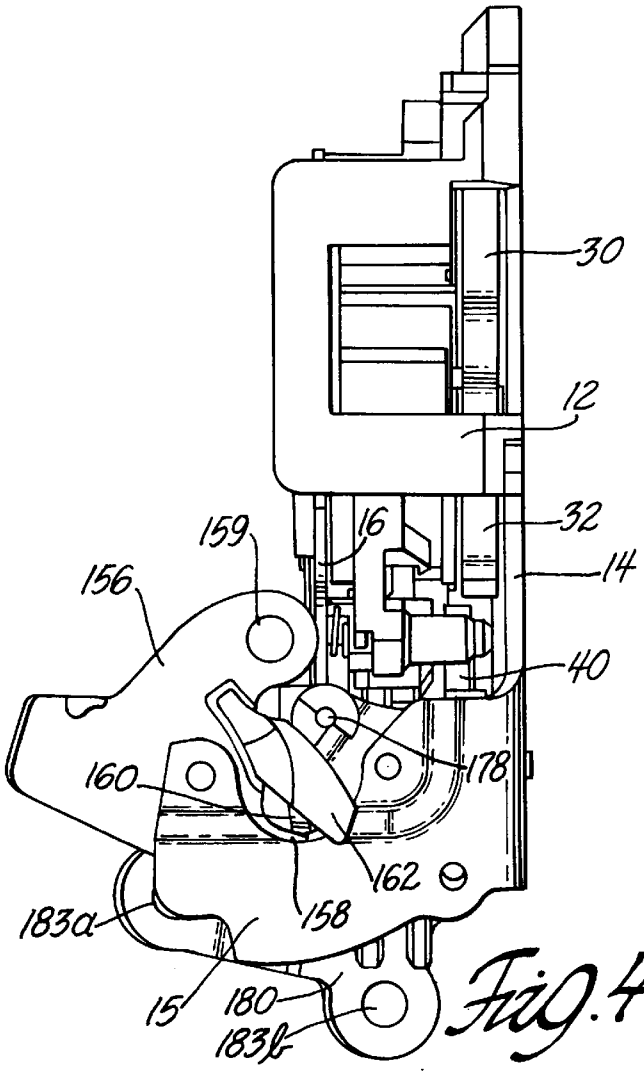
FIG. 4B is a fragmentary side view of the door latch of FIG. 2 taken substantially along the line 4B—4B of FIG. 4A looking in the direction of the arrows.
Figure 4A:
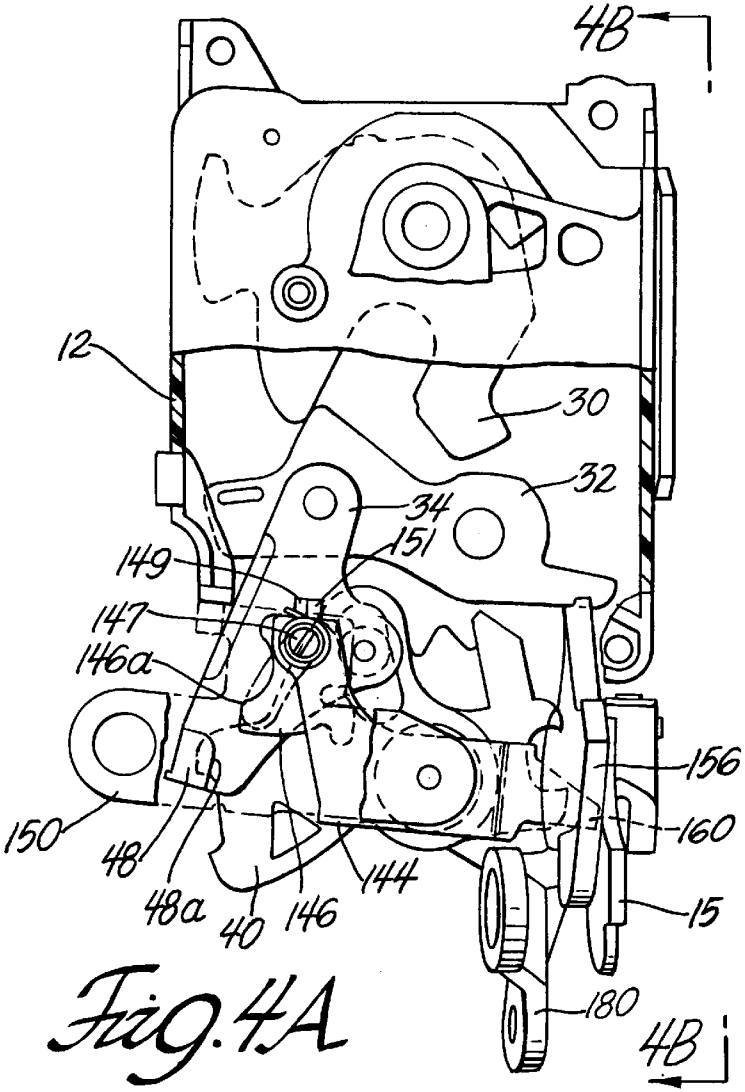
FIG. 4A is a fragmentary rear view of the door latch of FIG. 2 showing various parts in position when the vehicle door latch is latched and locked.
Figure 5A:
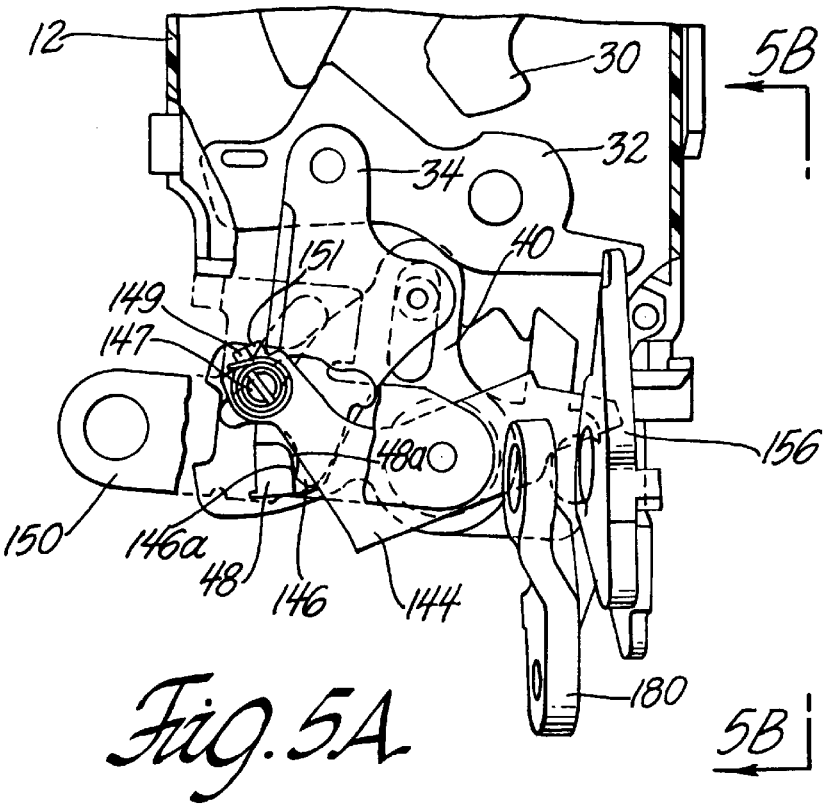
FIG. 5A is a fragmentary rear view of the door latch of FIG. 2 showing the parts in position at the end of a first stroke where the vehicle door latch is latched and unlocked.
Figure 5B:
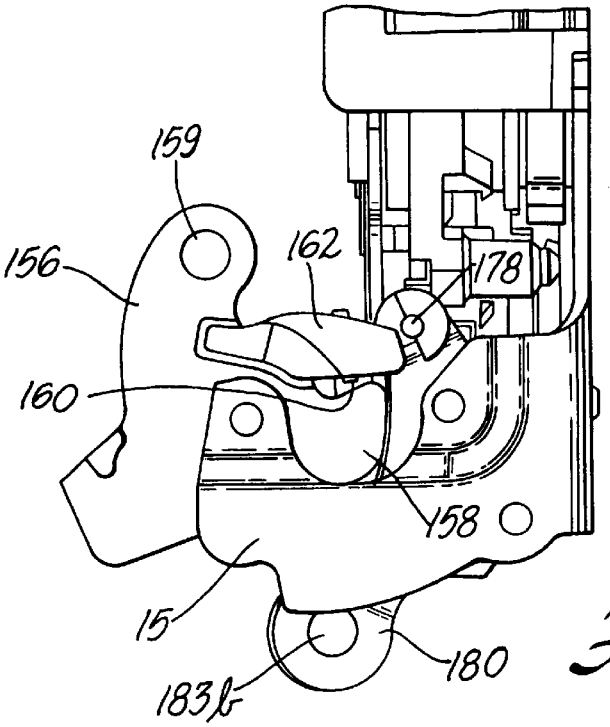
FIG. 5B is a fragmentary side view of the door latch of FIG. 2 taken substantially along the line 5B—5B of FIG. 5A looking in the direction of the arrows.
Figure 6A:
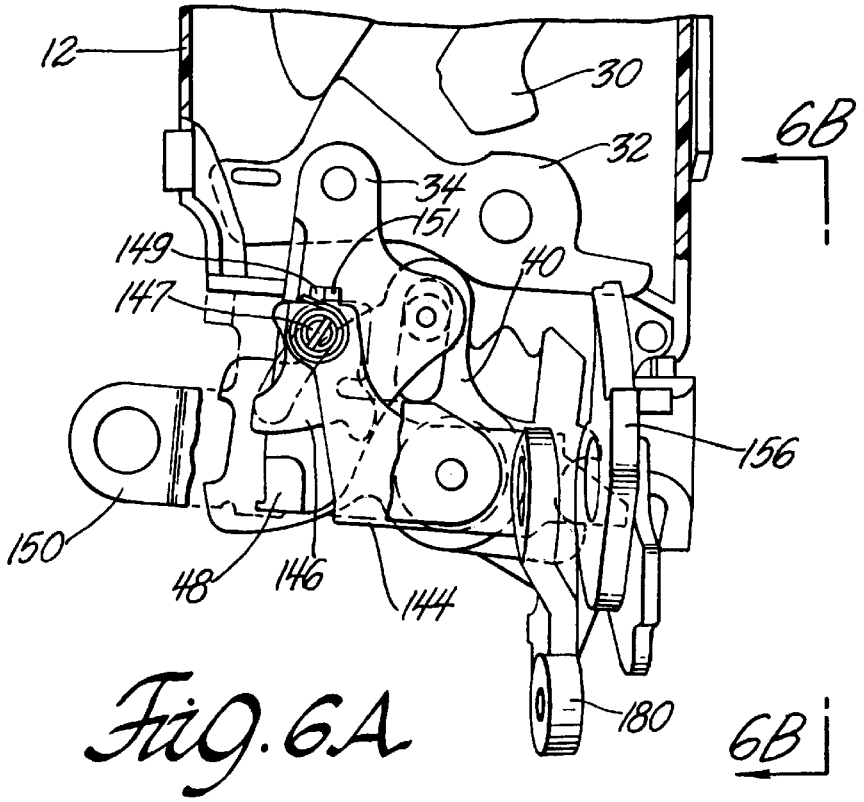
FIG. 6A is a fragmentary rear view of the door latch of FIG. 2 showing the parts in position at the end of a return stroke where the vehicle door latch is unlocked and armed for an unlatching operation.
Figure 6B:
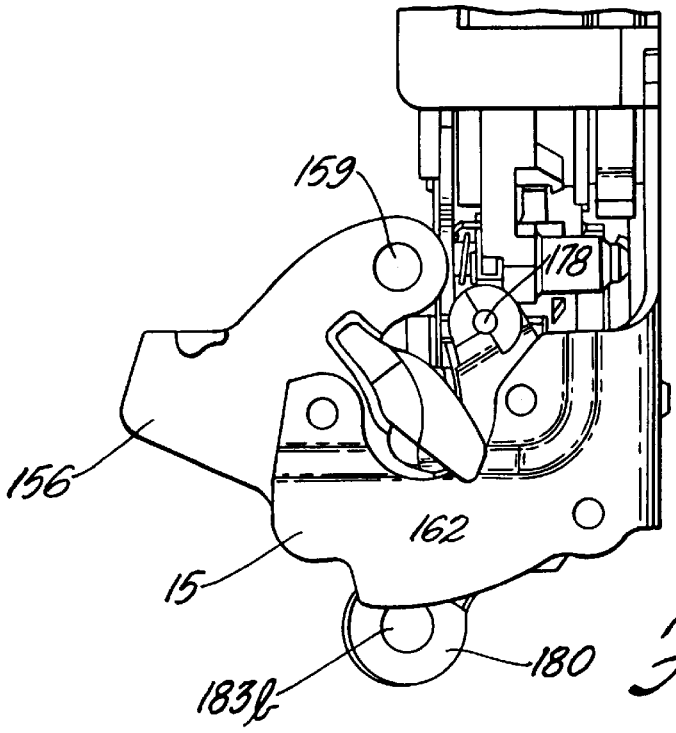
FIG. 6B is a fragmentary side view of the door latch of FIG. 2 along the line 6B—6B of FIG. 6A looking in the direction of the arrows.

FIGS. 4A and 4B are fragmentary rear and side views of door latch 100 in a latched and locked condition. In the initial stroke of the double pump operation, inside handle lever 156 is pivoted counterclockwise from the latching position shown in FIGS. 4A and 4B to the unlatching position shown in rear view FIG. 5A and side view FIG. 5B. During this movement, end tab 158 engages tongue 160 of unlatching lever 144 rotating unlatching lever counterclockwise from the latched position shown in FIGS. 4A and 4B to the unlatched position shown in FIGS. 5A and 5B bypassing tab 48 of intermittent lever 34. Cam arm 162 also engages follower pin 178 of inside locking lever 180 rotating inside locking lever 180 clockwise from the locked position shown in FIGS. 4A and 4B to the unlocked position shown in FIGS. 5A and 5B. Inside locking lever 180 in turn rotates locking lever 40 counterclockwise from the locked position shown in FIGS. 4A and 4B to the unlocked position shown in FIGS. 5A and 5B. Locking lever 40 in turn rotates intermittent lever 34 counterclockwise from the locked position shown in FIGS. 4A and 4B to the unlocked position shown in FIGS. 5A and 5B. As intermittent lever 34 swings counterclockwise, tab 48 engages transfer member 146 and rotates it counterclockwise against the action of spring 148 from the armed position shown in FIGS. 4A and 4B to the disarmed position shown in FIGS. 5A and 5B. In this regard, it should be noted that the cam arm 162 is shaped so that the unlatching lever 144 swings transfer member 146 down in front of tab 48 before intermittent lever 34 swings tab 48 into the transfer member 146 so that radial tab surface 48*a* engages radial face 146*a*, rotating transfer member 146 counterclockwise. Vehicle door latch 100 is now unlocked but still latched.

Door latch 100 is now unlatched by re-arming the vehicle door latch 100 in a return stroke and then operating the latch mechanism in a second stroke. First, unlatching lever 144 is released by releasing and/or returning the inside door handle or other operator for inside door lever 156 to the beginning of its stroke, returning inside door lever 156 to the latched position shown in FIGS. 6A and 6B (and FIGS. 4A and 4B, also). As unlatching lever 144 rotates clockwise and returns to the generally horizontal latched position, transfer member 146 rotates clockwise on unlatching lever 144 and returns to the generally vertical position under the action of coil spring 148. Unlatching lever 144 and transfer member 146 are now re-armed and positioned to unlatch door latch 100. (In this regard, it should be noted that a cam surface 152 of transfer member 146 cooperates with surfaces 153 of housing 12 to return transfer member 146 to the armed position in the event that spring 148 fails.)

Figure 7A:
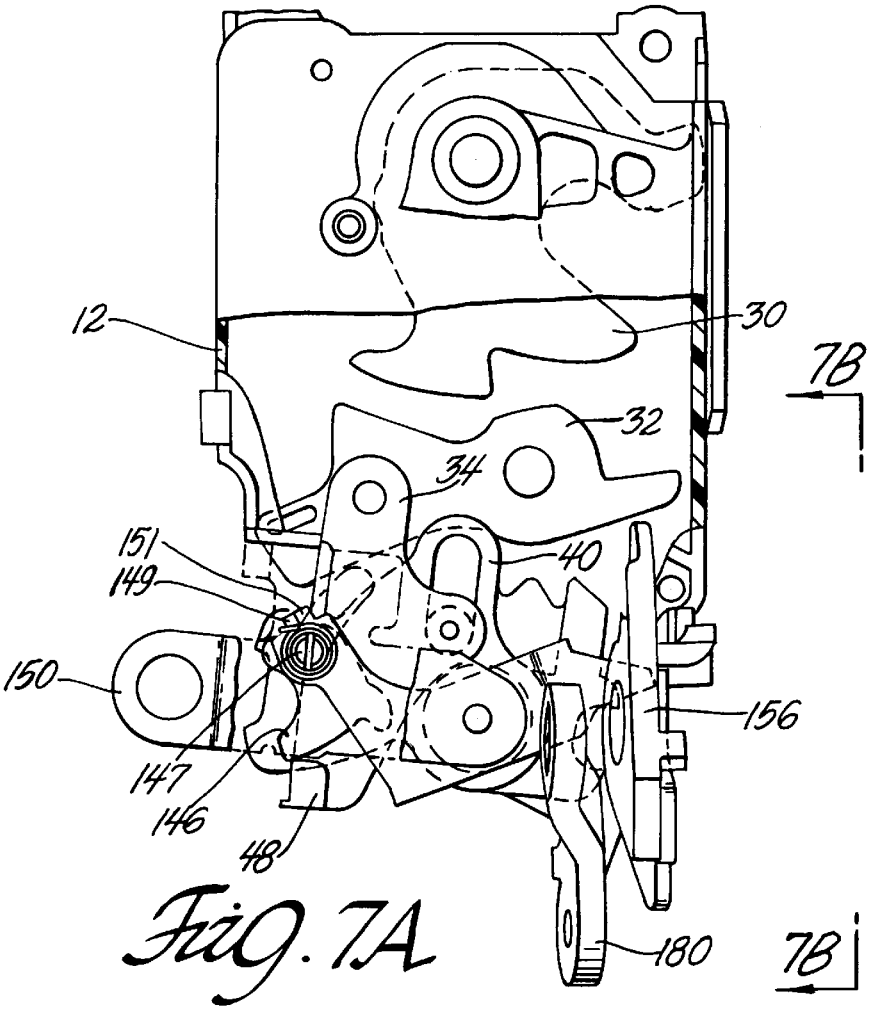
FIG. 7A is a fragmentary rear view of the door latch of FIG. 2 showing the parts in position at the end of a second stroke where the vehicle door latch is unlocked and unlatched.
Figure 7B:
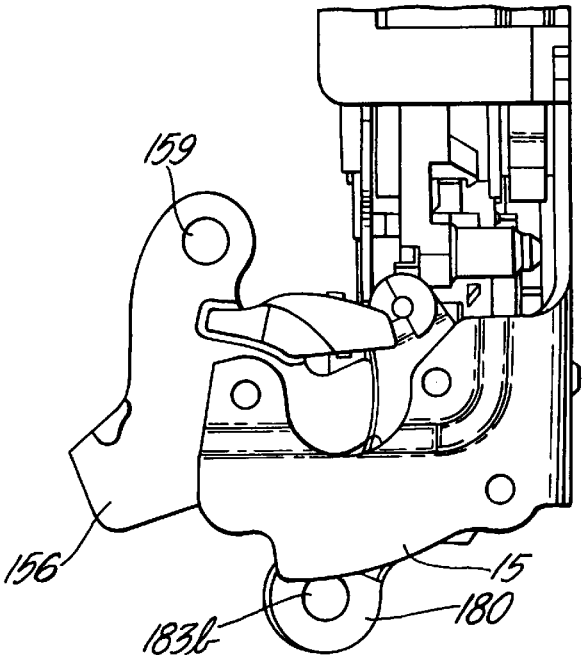
FIG. 7B a fragmentary side view of the door latch of FIG. 2 taken substantially along the line 7B—7B of FIG. 7A looking in the direction of the arrows.

The re-armed door latch 100 is then unlatched by a second stroke of the inside door handle or other operator that rotates inside handle lever 156 and unlatching lever 144 counterclockwise to their respective unlatched positions shown in FIGS. 7A and 7B. When unlatching lever 144 rotates counterclockwise, transfer member 146 engages the top of tab 48 and pulls intermittent lever 34 down from the latched position shown in FIGS. 6A and 6B to the unlatched position shown in FIGS. 7A and 7B. When intermittent lever 34 is pulled down, detent 32 pivots counterclockwise releasing fork bolt 30. The vehicle door may then be pushed open manually by rotating fork bolt 30 to the unlatched position shown in FIGS. 7A and 7B. Like the prior art vehicle door latch 10, vehicle door latch 100 automatically latches when the vehicle door is slammed shut in a well-known manner. This returns the parts to the position shown in FIGS. 6A and 6B. Vehicle door latch 100 may then be locked by rotating the inside locking lever 180 counterclockwise to the locked position shown in FIGS. 4A and 4B with a sill button or the like.

Thus, door latch 100 can be unlocked and unlatched by a single operator such as an inside door handle or the like in a double pump or two stroke operation. Moreover, the vehicle door latch 100 can still be locked and unlocked independently of the operator by a sill button or the like.

Many modifications and variations of the present invention in light of the above teachings may be made. It is, therefore, to be understood that, within the scope of the appended claims, the invention may be practiced otherwise than as specifically described.

We claim:

1. A vehicle door latch having a locking mechanism and a latching mechanism comprising:

the locking mechanism including an intermittent lever for unlatching the door that moves between a locked position and an unlocked position and that moves between a latched position and an unlatched position when in the unlocked position, the locking mechanism further including a locking linkage for moving the intermittent lever between the locked position and the unlocked position, the latching mechanism including an unlatching lever that moves between a latching position and an unlatching position and a transfer member that is movably mounted on the unlatching lever, the latching mechanism further including a latching linkage for moving the unlatching lever between the latching position and the unlatching position, the latching linkage engaging the locking linkage as the latching linkage moves the unlatching lever from the latching position to the unlatching position in a first stroke so that the locking linkage moves the intermittent lever to the unlocked position, the intermittent lever engaging and moving the transfer member to an unarmed position when the intermittent lever is moved to the unlocked position, and the transfer member engaging the intermittent lever and moving the intermittent lever to the unlatched position when the unlatching lever is moved to the unlatched position and the intermittent lever is in the unlocked position whereby the door lock may be unlocked and unlatched by two strokes of the latching linkage.

2. The vehicle door latch according to claim 1 wherein the transfer member pivots on the unlatching lever.

3. The vehicle door latch according to claim 1 wherein the unlatching lever is generally horizontal when in the latching position and wherein the transfer member pivots on an elevated end of the unlatching lever.

4. The vehicle door latch according to claim 2 wherein the transfer member is spring biased to an armed position on the unlatching lever.

5. The vehicle door latch according to claim 2 wherein the transfer member has a cam surface that cooperates with a housing surface to move the transfer member to an armed position.

6. An automotive vehicle door latch according to claim 2 wherein the intermittent lever has a tab that is engaged by the transfer member to move the intermittent lever to the unlatched position and that engages the transfer member to move the transfer member when the intermittent member is moved to the unlocked position with the unlatching lever in the unlatched position.

7. A vehicle door latch having a locking mechanism and a latching mechanism comprising:

the locking mechanism including an intermittent lever for unlatching the door that moves between a locked position and an unlocked position and that moves between a latched position and an unlatched position when in the unlocked position, and a locking linkage for moving the intermittent lever between the locked position and the unlocked position, the locking linkage having an inside locking lever, the latching mechanism including an unlatching lever that moves between a latching position and an unlatching position, a transfer member that is movably mounted on the unlatching lever, and a latching linkage for moving the unlatching lever between the latching position and the unlatching position, the latching linkage including an inside handle lever, the inside handle lever engaging and moving the inside locking lever as the latching linkage moves the unlatching lever from the latching position to the unlatching position in a first stroke so that the locking linkage moves the intermittent lever to the unlocked position, the intermittent lever engaging and moving the transfer member to an unarmed position when the intermittent lever is moved to the unlocked position, and the transfer member engaging the intermittent lever and moving the intermittent lever to the unlatched position when the unlatching lever is moved from the latched position to the unlatched position and the intermittent lever is in the unlocked position whereby the door lock may be unlocked and unlatched by two strokes of the inside handle lever.

8. The vehicle door latch according to claim 7 wherein the inside handle lever has a cam arm that engages a follower pin of the inside locking lever for moving the locking linkage from the locked position to the unlocked position, whereby the inside locking lever may be operated independently of the inside handle lever to move the locking mechanism from the unlocked position to the locked position.

9. The vehicle door latch according to claim 8 wherein the intermittent lever has a tab for moving the transfer member and the cam arm is shaped so that the unlatching lever moves the transfer member in front of the tab for movement by the intermittent lever.

10. The vehicle door latch according to claim 9 wherein the transfer member is spring biased to an armed position on the unlatching lever.

11. The vehicle door latch according to claim 9 wherein the transfer member has a cam surface that cooperates with a housing surface to move the transfer member to an armed position.

12. The vehicle door latch according to claim 9 wherein the tab of intermittent lever has a top that is engaged by the transfer member to move the intermittent lever to the unlatched position when the intermittent member is in unlocked position.

* * * * *